United States Patent [19]

Akasaka et al.

[11] Patent Number: 4,960,084

[45] Date of Patent: Oct. 2, 1990

[54] VALVE TIMING CONTROL SYSTEM FOR INTERNAL COMBUSTION ENGINE

[75] Inventors: Akio Akasaka; Seiji Suga; Makoto Yasuda, all of Kanagawa, Japan

[73] Assignees: Nissan Motor Co., Ltd.; Atsugi Unisia Corp., both of Yokohama, Japan

[21] Appl. No.: 414,236

[22] Filed: Sep. 29, 1989

[30] Foreign Application Priority Data

Sep. 30, 1988 [JP] Japan ..... 63-128919[U]

[51] Int. Cl.[5] ..... F01L 1/34

[52] U.S. Cl. ..... 123/90.17; 123/90.31; 464/2

[58] Field of Search ..... 123/90.15, 90.17, 90.31, 123/420, 500, 501; 464/1, 2, 24, 160

[56] References Cited

U.S. PATENT DOCUMENTS

| | | | |
|---|---|---|---|
| 4,754,727 | 7/1988 | Hampton | 123/90.17 |
| 4,811,698 | 3/1989 | Akasaka et al. | 123/90.17 |
| 4,841,924 | 6/1989 | Hampton et al. | 123/90.17 |
| 4,862,843 | 9/1989 | Kawamoto et al. | 123/90.17 |

FOREIGN PATENT DOCUMENTS

| | | | |
|---|---|---|---|
| 0268810 | 11/1986 | Japan | 123/90.15 |
| 0003111 | 1/1987 | Japan | 123/90.17 |
| 0131808 | 6/1988 | Japan | 123/90.15 |
| 0134012 | 5/1989 | Japan | 123/90.17 |

*Primary Examiner*—David A. Okonsky
*Assistant Examiner*—Weilun Lo
*Attorney, Agent, or Firm*—Pennie & Edmonds

[57] ABSTRACT

A valve timing control system includes a valve timing control mechanism constructed independently of the camshaft with avoiding direct engagement between a timing adjusting element and the camshaft. For enabling this, an inner cylinder is provided as an additional component. The inner cylinder is provided with an external gear teeth engaging with the internal gear teeth of a timing adjusting element. The inner cylinder is designed to be firmly secured to the camshaft by means of an axial fastening bolt. Such construction permits advance adjustment of phase relationship between the sprocket and the inner cylinder before fixing the inner cylinder on the camshaft.

11 Claims, 2 Drawing Sheets

VALVE TIMING CONTROL SYSTEM FOR INTERNAL COMBUSTION ENGINE

BACKGROUND OF THE INVENTION

1. Field of the Invention

The present invention relates generally to a valve timing control system for an internal combustion engine, which control system adjusts timing of opening and closing of an intake and an exhaust valve depending upon an engine driving condition. More specifically, the invention relates to a valve timing control system having a simplified construction for easy installation for an automotive internal combustion engine.

2. Description of the Background Art

U.S. Pat. No. 4,231,330 discloses a variable valve timing control system for an automotive internal combustion engine. In the disclosed system, a camshaft for controlling timing of opening and closing of an intake and an exhaust valve is engaged with a sleeve at its front end through thread engagement. A valve timing control mechanism includes an outer cylinder carrying a timing sprocket drivingly associated with an output shaft of the engine via a timing chain or timing belt for rotation in synchronism therewith. The outer cylinder is formed with an internal gear teeth. The internal gear teeth is engaged with an external gear teeth of a cylindrical timing adjusting element which has an internal gear teeth engaging with the external gear teeth of the camshaft. One of the external and internal gear teeth of the timing adjusting element is formed into a helical gear. The timing adjusting element is hydraulically or mechanically driven in axial direction depending upon the engine driving condition for causing relative angular offset of the camshaft with respect to the timing sprocket. By this, relative rotational phases of the camshaft and the sprocket can be offset for causing variation of the valve opening and closing timings.

As set forth, the prior proposed valve timing control system takes a strategy of establishing direct engagement of the timing adjusting element with the external gear teeth of the camshaft. During assembling process, meshing of the timing adjusting element and the external teeth of the camshaft is down simultaneously of installation of the sleeve onto the front end of the camshaft by means of fastening bolts. Such construction includes shortcoming in difficulty of adjustment of the relative angular position of the camshaft and the timing sprocket. Namely, in the prior proposed system, adjustment of relative angular positions of the camshaft and the timing sprocket has to be done after installation of the sleeve onto the camshaft. This requires special adjusting tool or device for satisfactorily adjust the initial phase relation between the camshaft and the sprocket. As a result, production process becomes substantially complicate and costful.

SUMMARY OF THE INVENTION

Therefore, it is an object of the present invention to provide a valve timing control system which solves the problems in the prior art and thus can simplify the assembling operation.

Another object of the invention is to provide a valve timing control system which can facilitate easier adjustment of phase relationship between a camshaft and a timing sprocket.

A further object of the invention is to provide a valve timing control system which avoids direct engagement between the camshaft and a timing adjusting element and thus permits fastening of the timing control mechanism onto the camshaft after completing adjustment of phase relationship of the timing adjusting element and the sprocket.

In order to accomplish aforementioned and other objects, a valve timing control system, according to the present invention, includes a valve timing control mechanism constructed independently of the camshaft with avoiding direct engagement between a timing adjusting element and the camshaft. For enabling this, an inner cylinder is provided as an additional component. The inner cylinder is provided with an external gear teeth engaging with the internal gear teeth of a timing adjusting element. The inner cylinder is designed to be firmly secured to the camshaft by means of an axial fastening bolt. Such construction permits advance adjustment of phase relationship between the sprocket and the inner cylinder before fixing the inner cylinder on the camshaft.

According to one aspect of the invention, a valve timing control system for adjusting angular phase relationship between an engine revolution synchronous element and a cam driving element, comprises:

a first cylindrical component associated with the engine revolution synchronous element for co-rotation therewith;

a second cylindrical component oriented within the interior space of the first cylindrical component in coaxial and radially spaced relationship with the first cylindrical component, and associated with the cam driving element for co-rotation therewith, the second cylindrical component having radial extension supporting one end of the first cylindrical component;

a third component disposed between the first and second components for transmitting rotational torque to the cam driving element via the second cylindrical component, the third component being movable relative to the first and second cylindrical components;

a forth component cooperative with the third component for converting axial movement of the third component into an angular phase shift of one of the first and second components relative to the other for causing variation of angular phase relationship between the engine revolution synchroneous element and a cam driving element at predetermined phase relationship; and a fifth component for securing the first, second third and fourth components in an assebled form, the fifth component including means for supporting the other end of the first component, the supporting means establishing sliding contact with the first cylindrical component for permitting relative angular displacement between the first and second cylindrical components.

The first cylindrical component is provided with internal gear teeth interengaged with external gear teeth formed with the third component and the third component is also provided with internal gear teeth interengaged with external gear teeth of the second cylindrical component for transferring the rotational torque. The third component may be formed into a hollow cylinder having the external and internal gear teeth on inner and outer periphery thereof, and the cylindrical third component being coaxially arranged with the first and second cylindrical components.

In the preferred construction, the valve timing control system may further comprises a biasing means associated with the third component for biasing the latter to an initial axial position, and an actuation means exerting an actuation force against the biasing force of the biasing means for causing axial shifting of the third means so that angular phase shifting between the engine revolution synchronous element and the cam driving element is caused. The actuation means comprises a hydraulic means for varying a hydraulic pressure exerted on the third component in a direction opposite to the direction toward which the biasing force of the biasing means is exerted, and the hydraulic means is variable of the hydraulic pressure depending upon an engine driving condition.

Preferably, the supporting means comprises an annular flange-like section integrally formed with the fifth means. In the alternative, the supporting means comprises a radial extension extending in radially inward and having an inner peripheral edge slidingly contact with the outer periphery of the second cylindrical component.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

BEST MODE FOR CARRYING OUT THE INVENTION

Figure 1:
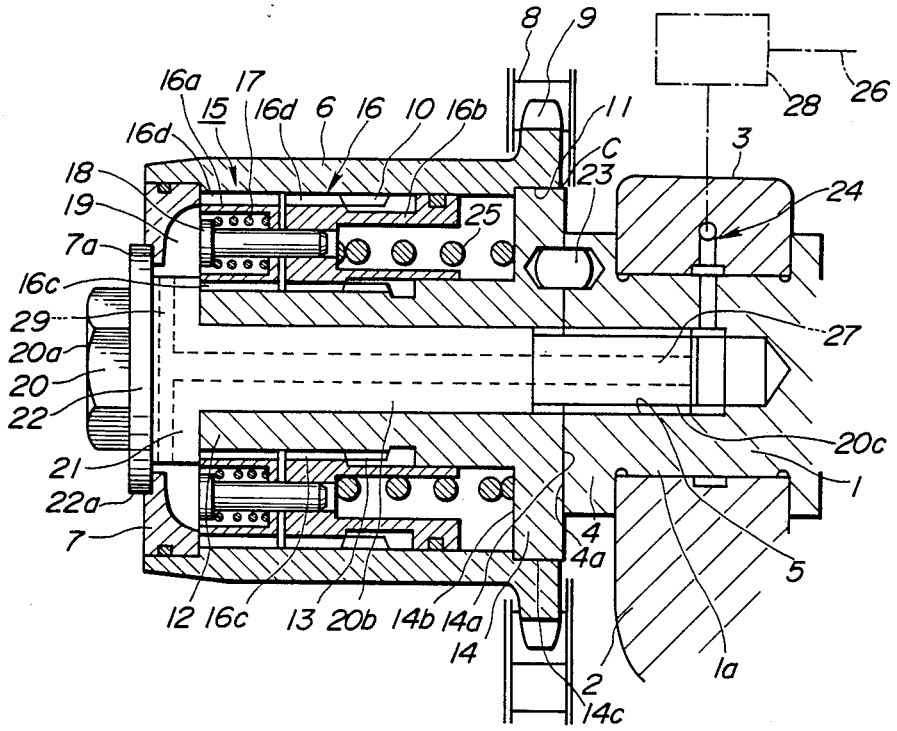
FIG. 1 is a sectional view of the first embodiment of a valve timing control system of according to the present invention.

Referring now to the drawings, particularly to FIG. 1, the first embodiment of a valve timing control system, according to the present invention, is applicable for adjusting timing of opening and closing of an intake valve and an exhaust valve of the internal combustion engine. In general, the valve timing control is performed depending upon the engine driving conditions, such as an engine speed, an engine load and so forth. The valve timing control system of the invention is particularly applicable for an automatic valve timing control.

FIG. 1 shows a front end section of a camshaft 1 provided for opening and closing an intake valve and exhaust valve (not shown) providing in an intake port and an exhaust port of each engine cylinder in per se well known manner. As clearly seen in FIG. 1, the camshaft 1 is rotatably supported by means of one or more bearings 3 (only one is shown) in a cylinder head 2. The crankshaft 1 is provided with an integrally formed annular disc form flange 4 at the front end. The flange 4 has a flat front end surface 4a.

A valve timing control mechanism is associated with the front end of the camshaft 1 for adjusting angular phase of the camshaft 1 relative to an engine output shaft (not shown) which is rotatingly driven in synchronism with an engine revolution and thus representative of the engine driving cycle position. The valve timing control mechanism includes an outer cylinder 6. The outer cylinder 6 is formed integrally with a cam sprocket 9 at the rear end thereof.

It should be appreciated that though the shown embodiment has the cam sprocket 9 formed integrally with the outer cylinder 6, it may be possible to form the cam sprocket separately from the outer cylinder and rigidly fixing to each other for co-rotation. Furthermore, though the shown embodiment employs chain drain power train for driving the camshaft 1 by the driving torque supplied through the output shaft and thus the cam sprocket is employed, it may be replaced with a cam pulley in case that the power train is formed by a belt.

The cam sprocket 9 is driven by a timing chain 8 for transmitting torque from the output shaft. The outer cylinder 6 is formed with a relatively long internal gear teeth 10 axially extending at the inner peripheral wall thereof. The outer cylinder 6 is further provided with a rear end bore 11 having an inner diameter greater than that of the major section thereof. An inner cylinder 12 is disposed within the interior space of the outer cylinder 6 with orienting the outer periphery thereof away from the inner periphery of the outer cylinder. The inner cylinder 12 is integrally formed with an annular flange 14 having a flat rear end surface 14a, and a flat front end surface 14b, and an outer circumferential surface 14c. The inner cylinder 12 includes an external gear teeth 13 formed on the outer periphery thereof. The inner cylinder 12 is connected to the camshaft 1 via face contact between the flanges 4 and 14 in such a manner that the rear end surface 14a abuts the front end surface 4a. The outer circumferential portion 14b of the flange 14 is rotatably fitted into the rear bore 11 of the outer cylinder 6 such that the outer peripheral surface 14c abuts the inner peripheral surface of the outer cylinder 6 defining the rear bore in an airtight fashion.

A phase adjusting mechanism 15 is provided between the outer cylinder 6 and the inner cylinder 12. The phase adjusting mechanism 15 includes a ring gear member 16 which has a first gear element 16a and a second ring gear element 16b. The first and second ring gear elements 16a and 16b are arranged in alignment with each other for forming essentially cylindrical gear member. Internal and External gear teeth 16c and 16d are formed on the inner and outer peripheries of the first and second gear elements 16a and 16b. As can be seen, the internal and external gear teeth 16c and 16d extend in axial direction over the first and gear elements 16a and 16b have essentially the same geometry with regard to the inner and outer teeth. These ring gear elements 16a and 16b are interconnected by one or more connecting pins 18 which are fixed on the second ring gear element 16b through the annular hollow defined in the first ring gear element 16a. The annular hollow is traditionally filled with elastic materials, such as cylindrical rubber bushing attached by vulcanizing. Alternatively, as shown in FIG. 1, a plurality of coil springs 17 may be provided in the annular hollow, while the springs 17 are supported by the heads of the connecting pins 18 serving as spring seats. When the first and second ring gear elements 16a and 16b, and the connecting pins 18 are assembled, the first and second ring gear elements 16a and 16b are interconnected in such a manner as to be slightly offset from each other. In other words, the angular phase relationship between the ring gear elements 16a and 16b is designed so as to be set an angular position slightly offsets from an angular position in which the tooth traces between the two ring gear elements 16a and 16b are exactly aligned with each other. In these constructions, when the ring gear member 16 is installed between the outer and inner cylinders 6 and 12, the external and internal gear teeth 16*d* and 16*c* are respectively meshed with the internal gear teeth 10 of the outer cylinder 6 and the external gear teeth 13 of the inner cylinder 12. At least one of the two meshing pairs of teeth (10 and 16*d*; 13 and 16*c*) is helical to provide axial sliding movement of the ring gear relative to the camshaft 1. Furthermore, since the offset magnitude is preset to be a slightly greater than that of the ring gear member when meshed with its connecting gear teeth, backlashes between the two meshing pairs of teeth (10 and 16*d*; 13 and 16*c*) are eliminated by the cylindrical rubber bushing or the coil springs 17 serving as a backlash eliminator.

An annular end plate 7 is fitted through a seal ring into the front end of the outer cylinder 6 in an airtight fashion. The end plate 7 and the inner cylinder 12 are fixed together on the flange 4 of the camshaft 1 through a relatively thick plain washer 21 having a high rigidity, by a fastening bolt 20 such that the bolt 20 is screwed through the cylindrical hollow defined in the inner cylinder 12 into a threaded portion of the inner bore 5 defined in the front end 1*a* of the camshaft 1. When the bolt 20 is screwed into the front end 1*a* of the camshaft 1, the annular end plate 7 is firmly fixed on the outer cylinder 6 in such a manner that the outer peripheral surface of the end plate 7 is press-fitted into the inner peripheral surface of the front end of the outer cylinder 6. The end plate 7 is formed with an annular recess 7*a* extending along the inner circumferential edge. The bolt 20 has a head 20*a*, an intermediate shaft section 20*b*, and a threaded section 20*c* engaging with the threaded portion 5*a* of the camshaft 1. The bolt 20 is further formed with an annular extension 21 and an annular supporting flange 22. The supporting flange 22 has a circumferential edge portion 22*a* which is slidingly engaged with the recess 7*a* so that the outer cylinder 6 with the end plate 7 is rotatable in relation to the bolt 20.

In these constructions, a pressure chamber 19 is defined by the inner wall of the end plate 7, the front end of the first ring gear element 16*a*, and the front end of the inner cylinder 12 for introducing working fluid fed from the oil pan (not shown) via the engine oil pump (not shown). As clearly seen in FIG. 1, the axially forward movement of the ring gear member 16 is restricted by the abuttment between the inner wall of the end plate 7 and the front end of the first ring gear element 16*a*. Coversely, the axially backward movement of the ring gear member 16 is restricted by the abuttment between the front surface 14*b* of the flange 14 and the the rear end of the second ring gear element 16*b*.

In the first embodiment according to the invention, note that the inner cylinder 12 and camshaft 1 are interconnected through a knock-pin 23 serving as a positioning pin. The knock-pin 23 is press-fitted into a hole bored through the front surface 4*a* of the flange 4 in the axial direction of the camshaft 1.

The phase adjusting mechanism 15 further comprises a hydraulic circuit 24 for supplying and draining the working fluid from the oil pan to the pressure chamber 19, a compression spring 25 disposed between the second ring gear element 16*b* and the flange 14 for normally blasing the ring gear member 16 in an axially forward direction, and an electromagnetic flow control valve 28 for controlling the amount of the working fluid flowing through the hydraulic circuit 24. As shown in FIG. 1, the hydraulic circuit 24 includes an oil supply passage 27 defined through the fastening bolt 20 and extending axially and radial paths 29 extending radially through the annular extension 21.

The flow control valve 28 is controlled by a controller (not shown) which determines the operating state of the engine on the basis of signals output from various sensors, such as a crank angle sensor for monitoring a crank angle of the crankshaft, and an air flow meter for monitoring the amount of an intake air introduced through an air cleaner.

The valve timing control system for internal combustion engines according to the invention, operates as follows.

When the engine is operating under low load, the control signal from the previously described controller is in an OFF state, with the result that the flow control valve 28 blocks the flow of working fluid fed through the oil supply passage 27 to the pressure chamber 19. Since the oil within the pressure chamber is exhausted through apertures defined between the two meshing pairs of the gear teeth (10 and 16*d*; 13 and 16*c*) via the passage (not shown) to the internal space defined by the cylinder head 2 and the cylinder head cover, the pressure within the pressure chamber 19 becomes low, while the working fluid flowing through the above mentioned apertures serves to lubricate the phase adjusting mechanism 15. As a result, as shown in FIG. 1, the ring gear member 16 is positioned at the leftmost position (viewing FIG. 1) by the spring 25. Under this condition, the relative phase angle between the sprocket 9 and the camshaft 1 is set to a predetermined initial phase angle in which an intake and exhaust valve timing relative to the crank angle is initialized.

Conversely, when the operating state of the engine is changed from a low load to a high load, the control signal from the controller is in an ON state, with the result that the pressurized working fluid from the oil pump (not shown) is through the main oil oil gallery, the flow control valve 28, the oil supply passage 27, to the pressure chamber 19, in that order. As a result, since the pressure within the pressure chamber 19 becomes high, the ring gear member 16 is moved in the right direction (viewing FIG. 1) against the spring force generated by the spring 25. Therefore, the phase angle between the outer cylinder 6 and the inner cylinder 12 (corresponding to the phase angle between the outer cylinder 6 and the camshaft 1) is relatively changed to a predetermined phase angle which corresponds to an optimal phase angle during high engine load conditions. In this manner, the intake and exhaust valve timing is controlled dependent upon the operating state of the engine.

In assembling of the valve timing control mechanism as set forth above, the angular phase relationship between the cam sprocket 9 and the camshaft 1 can be initially adjusted by connecting the inner cylinder 12 assembled with the outer cylinder 6 to the front end of the camshaft 1 by means of the knock-pin 23. Then, the phase adjusting mechanism 15 and the front plate 7 are assembled. Thereafter, the assembly is fixed by means of the fastening bolt 20. During tightening of the fastening bolt, the angular phase relationship between the cam sprocket 9 and the camshaft 1 can be maintained. At the assembled condition, the supporting flange 22 of the fastening bolt 20 is in sliding contact with respect to the inner periphery of the recess 7*a* of the front plate 7. Fine adjustment of the phase angular relationship of the cam sprocket 9 and the camshaft 1 can be adjusted by rotating the bolt 20 together with the camshaft and the inner cylinder for initially set.

As will be appreciated herefrom, the shown embodiment facilitate easy installation of the valve timing control mechanism with allowing precise adjustment of the phase angular relationship between the cam sprocket and the camshaft. Furthermore, since the outer cylinder 6 is steadily supported by the inner cylinder 12 and the fastening bolt 20, smooth transfer of the rotational torque from the cam sprocket 9 to the camshaft 1 via the phase adjusting mechanism 15 can be obtained. In addition, since the shown embodiment allows to form the inner cylinder 12 with uniform cylinder wall thickness, the external gear teeth 13 of the inner cylinder can have uniform thickness through entire axial length. Therefore, wearing can be caused uniformly. Furthermore, because of uniform cylinder wall thickness and the external gear teeth thickness, shrinking is caused uniformly through the entire body for providing remarkably high yield in production.

In addition, in the shown construction, the front end of the camshaft can be formed into flat face, the camshaft can be commonly used for the engine which is not facilitated the valve timing control system. Also, since the inner cylinder per se is not required to establish thread engagement with other components, it is easy to produce. Furthermore, because of simplified constructions of the components, the whole assembly of the valve timing control system can be made compact and light weight.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

Figure 2:
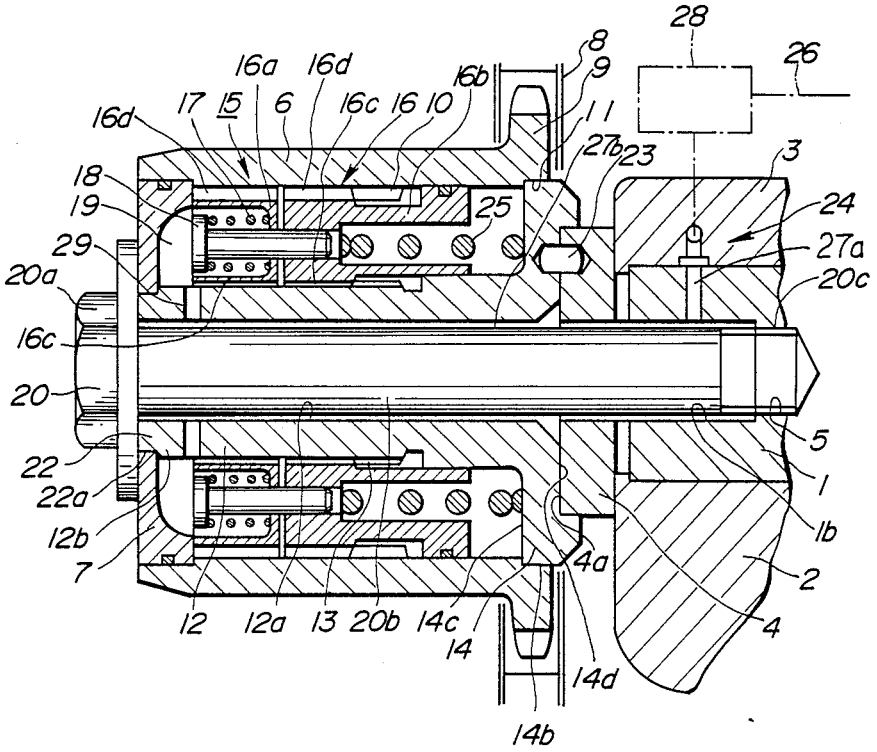
FIG. 2 is a sectional view of the second embodiment of a valve timing control system of according to the present invention.

For example, FIG. 2 shows another embodiment of the valve timing control system according to the present invention. The shown embodiment is principally differentiated from the former embodiment in the construction of the structure to supply the oil. In the shown construction, the phase adjusting mechanism 15 comprises a hydraulic circuit 24 for supplying and draining the working fluid from the oil pan to the pressure chamber 19. As shown in FIG. 2, the hydraulic circuit 24 includes an oil supply passage **27*a* radially extending in the camshaft 1, an intermediate oil passage 27*b* defined between the outer periphery of the shaft section 20*b* of the bolt 20 and the inner peripheries of the inner cylinder 12 and the front end 1*a* of the camshaft 1, and a communication passage 29 radially extending through the front end portion of the inner cylinder for fluid communication between the oil passage 27*a* and the pressure chamber 19 of the phase adjusting mechanism 15**.

In addition, in the shown embodiment, a collar 22' is employed as a replacement of the supporting flange 22 in the former embodiment.

As will be appreciated herefrom the present invention fulfills all of the objects and advantages sought therefor.

What is claimed is:

1. A valve timing control system for adjusting angular phase relationship between an engine revolution synchronous element and a cam driving element, comprising:

a first cylindrical component associated with said engine revolution synchronous element for co-rotation therewith;

a second cylindrical component oriented within the interior space of said first cylindrical component in coaxial and radially spaced relationship with said first cylindrical component, and associated with said cam driving element for co-rotation therewith, said second cylindrical component having radial extension supporting one end of said first cylindrical component;

a third component disposed between said first and second components for transmitting rotational torque to said cam driving element via said second cylindrical component, said third component being movable relative to said first and second cylindrical components;

a fourth component cooperative with said third component for converting axial movement of said third component into an angular phase shift of one of said first and second components relative to the other for causing variation of angular phase relationship between said engine revolution synchroneous element and a cam driving element at predetermined phase relationship; and a fifth component for securing said first, second, third and fourth components in an assembled form, said fifth component including means for supporting the other end of said first component, said supporting means establishing sliding contact with said first cylindrical component for permitting relative angular displacement between said first and second cylindrical components.

2. A valve timing control system as set forth in claim 1, wherein said first cylindrical component is provided with internal gear teeth interengaged with external gear teeth formed with said third component and said third component is also provided with internal gear teeth interengaged with external gear teeth of said second cylindrical component for transferring the rotational torque.

3. A valve timing control system as set forth in claim 2, wherein said third component is formed into a hollow cylinder having said external and internal gear teeth on inner and outer periphery thereof, and said cylindrical third component being coaxially arranged with said first and second cylindrical components.

4. A valve timing control system as set forth in claim 3, which further comprises a biasing means associated with said third component for biasing the latter to an initial axial position, and an actuation means exerting an actuation force against said biasing force of said biasing means for causing axial shifting of said third means so that angular phase shifting between said engine revolution synchronous element and said cam driving element is caused.

5. A valve timing control system as set forth in claim 4, wherein said actuation means comprises a hydraulic means for varying a hydraulic pressure exerted on said third component in a direction opposite to the direction toward which the biasing force of said biasing means is exerted, and said hydraulic means varies the hydraulic pressure depending upon an engine driving condition.

6. A valve timing control system as set forth in claim 1, wherein said supporting means comprises an annular flange-like section integrally formed with said fifth means.

7. A valve timing control system as set forth in claim 1, wherein said supporting means comprises a radial extension extending radially inward and having an inner peripheral edge slidingly contact with the outer periphery of said second cylindrical component.

8. A valve timing control system as set forth in claim 6 or 7, wherein said first cylindrical component is provided with internal gear teeth interengaged with external gear teeth formed with said third component and said third component is also provided with internal gear teeth interengaged with external gear teeth of said second cylindrical component for transferring the rotational torque.

9. A valve timing control system as set forth in claim 8, wherein said third component is formed into a hollow cylinder having said external and internal gear teeth on inner and outer periphery thereof, and said cylindrical third component being coaxially arranged with said first and second cylindrical components.

10. A valve timing control system as set forth in claim 9, which further comprises a biasing means associated with said third component for biasing the latter to an initial axial position, and an actuation means exerting an actuation force against said biasing force of said biasing means for causing axial shifting of said third means so that angular phase shifting between said engine revolution synchronous element and said cam driving element is caused.

11. A valve timing control system as set forth in claim 10, wherein said actuation means comprises a hydraulic means for varying a hydraulic pressure exerted on said third component in a direction opposite to the direction toward which the biasing force of said biasing means is exerted, and said hydraulic means is variable of the hydraulic pressure depending upon an engine driving condition.

* * * * *